US005178199A

United States Patent [19]

Jackson

[11] Patent Number: 5,178,199

[45] Date of Patent: Jan. 12, 1993

[54] BI-PARTING SHUTTER SYSTEM

[75] Inventor: John Jackson, St. Helens, Great Britain

[73] Assignee: Rotalac Plastics Limited, Altrincham, England

[21] Appl. No.: 741,561

[22] Filed: Aug. 7, 1991

[51] Int. Cl.[5] ..... E06B 3/32

[52] U.S. Cl. ..... 160/87; 160/118; 160/122

[58] Field of Search ..... 160/118, 345, 87, 122, 160/241; 49/123

[56] References Cited

U.S. PATENT DOCUMENTS

| | | | |
|---|---|---|---|
| 1,198,896 | 9/1916 | Davis | 49/123 |
| 1,845,949 | 2/1932 | Wittemann | 160/345 |
| 2,576,613 | 11/1951 | Lermont . | |
| 4,050,191 | 9/1977 | Azuma | 49/123 X |
| 4,096,902 | 6/1978 | Junod | 160/122 |
| 5,052,459 | 10/1991 | Grossenbacher | 160/122 |

FOREIGN PATENT DOCUMENTS

| | | | |
|---|---|---|---|
| 5137 | 11/1979 | European Pat. Off. . | |
| 23427 | 2/1981 | European Pat. Off. . | |
| 33499 | 4/1885 | Fed. Rep. of Germany . | |
| 885999 | 1/1962 | United Kingdom . | |
| 981734 | 1/1965 | United Kingdom . | |
| 1009389 | 11/1965 | United Kingdom . | |
| 1485964 | 9/1977 | United Kingdom . | |
| 1493658 | 11/1977 | United Kingdom . | |
| 2227789 | 8/1990 | United Kingdom | 49/123 |

*Primary Examiner*—Blair M. Johnson

*Attorney, Agent, or Firm*—Dennison, Meserole, Pollack & Scheiner

[57] ABSTRACT

A bi-parting shutter system having two slidably displaceable shutters connected by a flexible belt arranged in a track and looped around two freely rotatable pulley wheels. The belt defines a first belt run connected to a first shutter by a first attachment, and a second belt run similarly connected to a second shutter by a second attachment. The second attachment includes a bracket having a generally hollow square cross section and located in the track. The first belt run freely passes through the second attachment, with movement of one shutter being transmitted to the other shutter.

9 Claims, 1 Drawing Sheet

BI-PARTING SHUTTER SYSTEM

This invention relates to a bi-parting shutter system, particularly for cupboards or cabinets provided with two shutters which it is intented or desired to operate in co-operation with each other.

The provision of one or more shutters to close an opening in a cupboard or cabinet is well known and such shutters are often a flexible roller-type shutter which is unfurled to cover the opening. Alternatively known shutters may be composed of a number of slats which are slideably housed within the cabinet or cupboard itself and move from an open position to a closed position when so required. Such shutters are often provided in pairs, each shutter covering one half of the access opening provided as part of the cupboard or cabinet. Similar arrangements are also known in relation to shutters, blinds, curtains etc. for windows or similar apertures.

Where two such shutters are provided it is often desirable that movement of one shutter should cause simultaneous and corresponding movement of the other shutter. Thus, for example, when one shutter is moved other half of the enclosure's opening) thus ensuring that the opening in the enclosure is completely covered. In order to provide such simultaneous and corresponding operation various forms of linkages have been proposed in the prior art. Such methods include the well known linking means consisting of a number of pulleys and wires connecting the two shutters such that displacement of a first shutter in one direction causes a corresponding displacement in a second shutter in the opposite direction.

Our co pending British pending application No. 8827127.5 provides a further method of linking two such shutters by way of a number of rigid pivotally mounted members operating in a cantilever-type configuration. These known methods however have several disadvantages. For example the known wire and pulley mechanisms require the provision of channels within the side walls of the enclosure for the wires to run through. If a wire should become detached or snagged within its channel it requries complete disassembly of the enclosure in order to free the wire and repair the apparatus. In the two embodiments proposed in our co-pending application the shutters are required to be of extra length, such as to include the top and bottom of the enclosure, in order to provide sufficient length to link to two ends of the shutters by the pivoted rigid members. In a second embodiment proposed in the co-pending application the shutters are linked at their respective moveable edges, however this causes the size of the access opening in the cupboard or cabinet to be restricted by the need to provide a track and slideable block assembly on each interior face of the cupboard or cabinet.

It is an object of the present invention to provide a bi-parting shutter system which does not require the use of extra lengths of shutter, which has a small number of moving parts and does not restrict the size of the access opening provided in the enclosure.

With this object in view the present invention provides a bi-parting shutter system comprising two shutters slideably arranged within an enclosure so as to be displaceable from a closed position in which the shutters co-operate to cover an opening in the enclosure and an open position in which the shutters are disposed within the enclosure and do not substantially cover the opening, the two shutters being connected to each other by linkage means such that movement of one shutter causes a corresponding displacement in the second shutter, characterised in that the linkage means is provided by a flexible belt arranged within a track displaceable edge of each flexible shutter, a first shutter being attached to a first run of the belt and a second shutter being attached to a second run of the belt by a bracket member having a hollow cross section, the bracket member being arranged so that the first run of the belt passes therethrough.

It will be appreciated that with the shutters attached in this manner movement of the first shutter, attached to the first belt run, will result in movement of the second shutter, attached to the second belt run, in the opposite direction and to an equal amount.

Preferably two tracks are provided, each track with its own belt adjacent to one slideably displaceable edge of the two shutters. Such an arrangement ensures more positive tracking and guidance of each shutter during its movement.

Advantageously the guide means are in the form of a rotatably mounted pulley or wheel about which the belt is guided. This arrangement ensures that the belt is positively tracked around the guide means and results in a smaller frictional force than would be present if the guide means were a fixed assembly.

Preferably the second shutter is attached to the second run by a hollow bracket member having substantially square cross section.

Advantageously the track is in the form of a C-shaped profile having a slit along one face thereof such that the first and second shutters may be attached to the first and second belt runs respectively.

A bi-parting shutter system according to the invention may be arranged either vertically or horizontally such that the attached shutters are displaced respectively either up and down or from side to side.

Preferably a cord pull or motor drive are provided attached to the flexible belt so as to cause movement thereof in a response to a control signal.

The invention will be described further by way of example with reference to the accompanying drawing in which.

Figure 1:
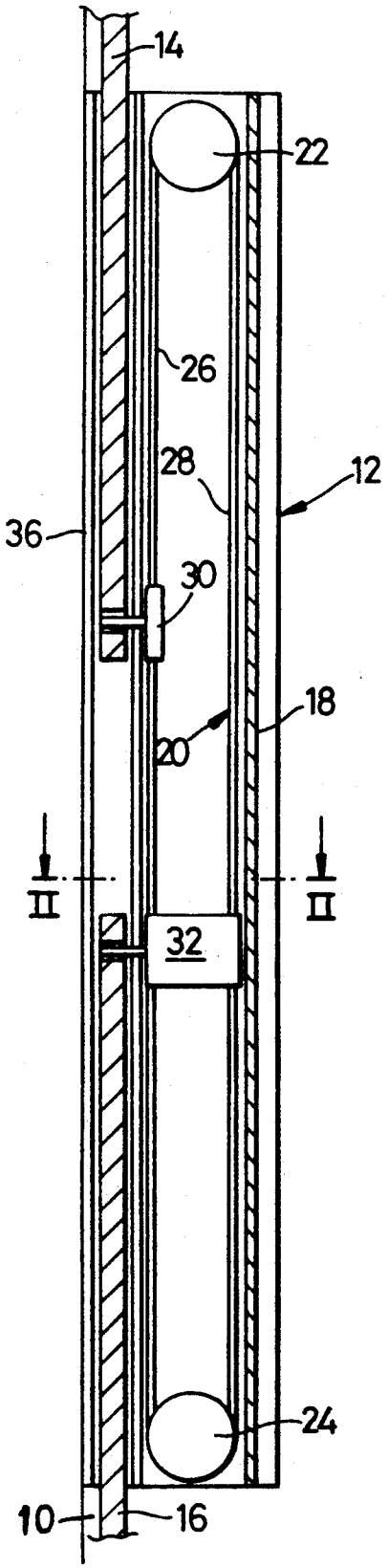
FIG. 1 is a sectional side view of a first preferred embodiment of the invention located in an enclosure, for example a cabinet.

Referring firstly to FIG. 1, a preferred embodiment of a bi-parting shutter system according to the invention is attached to an enclosure 10 of which only one wall is shown for simplicity. The enclosure 10 may be a cabinet or similar structure or could be a room or building or any other form of box shaped enclosure.

The enclosure 10 is provided with an opening in a front face thereof and one bi-parting shutter system 12 according to the invention is located immediately adjacent thereto. The opening in the enclosure is provided with two shutters 14, 16 which are slideably displaceable along a track (not shown) provided on the upper and lower surfaces of the enclosure 10. The shutters are thus displaceable between a closed position in which the shutters combine together to cover the opening and an open position in which they are retracted therefrom, leaving the opening uncovered, and are housed within the enclosure 10.

The bi-parting shutter system 12 comprises a track 18 of generally C-shaped profile (see FIG. 2) and arranged along substantially the whole length of one edge of the opening in the enclosure 10. The track 18 is provided with a flexible endless belt 20 arranged in a looped configuration about two freely rotatable pulley wheels 22, 24 located at respective ends of the track 18. Thus the flexible belt provides a first belt run 26 and a second belt run 28 parallel thereto between the two wheels 22, 24.

Each belt run 26, 28 is provided with respective attachment means 30, 32 which are rigidly connected to their respective belt runs so as to be moveable therewith. The attachment means 30, 32 include respective pins projecting through a slit 33 in the track 18. First attachment means 30 is attached via its pin to one edge of the first shutter 14 and the second attachment means 32 is attached to one edge of the second shutter 16. Thus the movement of the two shutters 14, 16 is connected via the attachment means 30, 32 and the flexible belt 20.

Figure 2:
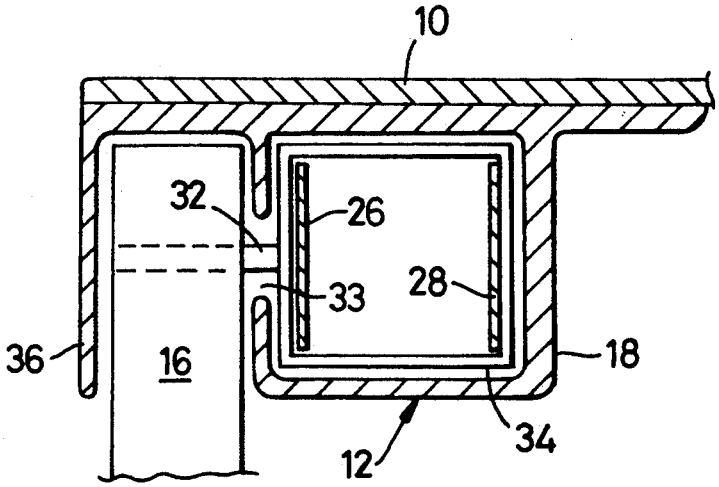
FIG. 2 is a sectional view along the line II—II of FIG. 1.
Figure 3:
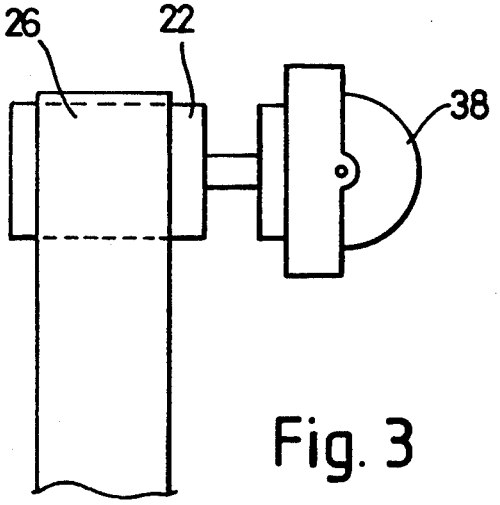
FIG. 3 is a schematic illustration of a motor drive for the shutter system.

As will be seen more clearly in FIG. 2 the second attachment means 32 also includes a bracket member 34 having a generally hollow square profile and adapted for location with the C shaped track 18. The bracket member 34 is directly attached to the second belt run 20 and the hollow profile permits the first belt run 26 to pass therethrough without any direct connection to the second attachment means 32.

In order to provide more certain and controllable tracking and movement of the two shutters 14, 16 a second bi-parting shutter system 12 according to an aspect of the invention may be provided on mutually opposed faces of the enclosure 10 adjacent to the opening therein. Thus each shutter 14, 16 is attached to its counterpart at each moveable edge.

It will be understood from the foregoing description that movement of, for example, the first shutter 14 in an upwards direction from the closed position will result in movement of the flexible belt 20 about the pulley wheels 22, 24. As the first attachment means 30 is moved along the first belt run 26 towards the upper wheel 22 the second belt run 28 and the connected attachment means 32 are also displaced by a corresponding distance towards the lower pulley wheel 24. Thus the second shutter 16 is moved downwards in conjunction with the raising of the first shutter 14.

It will be appreciated that no braking mechanism is required with a bi-parting shutter system according to an aspect of the invention as a force produced by the tendency of the second shutter to move downwards is resisted by an equal force required to move the first shutter upwards and by frictional losses about the pulley wheels 22, 24. Thus there will be no slippage of the shutters during use. Furthermore movement of the first shutter 14 will always cause an equal amount of movement of the second shutter 16 and the shutters will always meet at the same predetermined point over the opening in the enclosure 10. The predetermined point is preferably the middle of the enclosure as otherwise one shutter would never be completly retracted from the opening.

In an alternative embodiment a bi-parting shutter system is arranged substantially horizontal such that the shutters depend vertically from the linkage means and are slidably displaceable in a side to side manner. In this configuration the system includes one track which is preferably disposed above the shutters such that its operation is not inhibited.

A further advantageous modification of all aspects of the invention is to provide a draw cord or chain etc attached by a pulley to the linkage means such that movement of the shutters may be brought about simultaneously at a remote location. Alternatively a motor 38, or similar means, may be provided connected to the linkage means such that actuation of the motor will displace the shutters attached thereto.

It will be understood that the foregoing is illustrative and not restrictive of the scope of the invention and variations may be made thereto. For example the flexible belt may be made of any desired material providing the operating characteristics of the shutter system are maintained. The rotatable pulley wheels 22, 24 may be replaced by rotating shafts or fixed shafts having a low frictional component, for example shafts made of PTFE. Alternatively the guide means could be provided by suitable moulding of the end of the track 18. In the drawings the track 18 is provided with a lip 36 which covers the attachment means 30, 32. This lip is not necessary and merely serves as a protection to prevent the ingress of dirt etc into the interior of the C-shaped profile. The shutters 14, 16 may be of any convenient configuration, for example of a flexible material such as a roller blind or of a slatted construction as is common for this type of cabinet configuration.

I claim:

1. A bi-parting shutter system comprising two shutters slidably arranged within an enclosure for displacement between a closed position in which the shutters cooperate to cover an opening in the enclosure and an open position in which the shutters are disposed within the enclosure outward of the opening, the two shutters being connected to each other by linkage means whereby movement of a first shutter causes a corresponding displacement of the second shutter; characterized in that said shutters are connected in a manner as to preclude movement of a single shutter independently of the other shutter and wherein the corresponding displacement of said second shutter is equal to the movement of said first shutter and in an opposite direction whereby said shutters simultaneously close toward each other and open outwardly away from each other, said linkage means comprising a track, a single flexible endless belt arranged in said track, guide means mounted at each end of said track, said belt being mounted in a closed loop configuration about said guide means and providing two mutually opposed belt runs simultaneously movable in opposed directions, said track being disposed adjacent to said slidably displaceable shutters with said runs extending longitudinally in the direction of movement of said shutters and defining, relative to said shutters, a proximal belt run and a distal belt run, said first shutter being attached to said proximal run of said belt and bracket member attaching said second shutter to said distal run of said belt, said bracket member having a hollow cross section with said proximal run of said belt freely movable therethrough the cross-section of said bracket member being such as to fit closely yet slidably within said track.

2. A shutter system as claimed in claim 1 wherein each of said shutters includes opposed edges aligned in the direction of movement, and duplicate linkage means provided along said opposed edges.

3. A shutter system as claimed in claim 1 or 2 in which each guide means is in the form of a rotatably mounted pulley or wheel about which said belt is guided.

4. A shutter system as claimed in claim 3 in which the hollow cross-section of said bracket member is substantially square.

5. A shutter system as claimed in claim 4 in which said track is in the form of a C-shaped profile defining a slit along one face thereof opening toward said shutters with said shutters being attached to said belts through said slit.

6. A shutter system as claimed in claim 5 including a motor connected to said linkage means for actuation thereof and displacement of said shutters.

7. A shutter system as claimed in claim 1 or 2 in which the hollow cross-section of said bracket member is substantially square.

8. A shutter system as claimed in claim 1 in which said track is in the form of a C-shaped profile defining a slit along one face thereof opening toward said shutters with said shutters being attached to said belts through said slit.

9. A shutter system as claimed in claim 1 including a motor connected to said linkage means for actuation thereof and displacement of the shutters.

* * * * *